US008546691B2

(12) United States Patent
Watanabe et al.

(10) Patent No.: US 8,546,691 B2
(45) Date of Patent: Oct. 1, 2013

(54) DIFFERENTIAL SIGNAL TRANSMISSION CABLE

(75) Inventors: Haruyuki Watanabe, Hitachi (JP); Takahiro Sugiyama, Hitachi (JP); Akinari Nakayama, Hitachinaka (JP); Masafumi Kaga, Hitachi (JP); Sohei Kodama, Hitachi (JP)

(73) Assignee: Hitach Cable, Ltd., Tokyo (JP)

( * ) Notice: Subject to any disclaimer, the term of this patent is extended or adjusted under 35 U.S.C. 154(b) by 0 days.

(21) Appl. No.: 13/550,517

(22) Filed: Jul. 16, 2012

(65) Prior Publication Data

US 2013/0175081 A1 Jul. 11, 2013

(30) Foreign Application Priority Data

May 1, 2012 (JP) ..... 2012-000529

(51) Int. Cl.
*H01B 11/06* (2006.01)

(52) U.S. Cl.
USPC ..... 174/105 R; 174/102 R; 174/113 R; 174/116

(58) Field of Classification Search
USPC ..... 174/102 R, 105 R, 113 R, 117 F, 174/116
See application file for complete search history.

(56) References Cited

U.S. PATENT DOCUMENTS

| | | | | |
|---|---|---|---|---|
| 6,037,545 | A * | 3/2000 | Fox et al. | 174/110 R |
| 6,403,887 | B1 | 6/2002 | Kebabjian et al. | |
| 6,504,379 | B1 | 1/2003 | Jackson | |
| 6,677,518 | B2 * | 1/2004 | Hirakawa et al. | 174/36 |
| 6,740,808 | B1 * | 5/2004 | Chang | 174/36 |
| 7,790,981 | B2 | 9/2010 | Vaupotic et al. | |
| 2004/0026101 | A1 | 2/2004 | Ochi | |
| 2006/0054334 | A1 * | 3/2006 | Vaupotic et al. | 174/36 |
| 2008/0105449 | A1 * | 5/2008 | Kenny et al. | 174/34 |
| 2009/0260847 | A1 * | 10/2009 | Tobben et al. | 174/107 |
| 2011/0139485 | A1 * | 6/2011 | Matsuda et al. | 174/102 R |
| 2011/0315419 | A1 * | 12/2011 | Grant et al. | 174/34 |

FOREIGN PATENT DOCUMENTS

| | | | |
|---|---|---|---|
| JP | 2001-035270 | A | 2/2001 |
| JP | 2002-289047 | A | 10/2002 |
| JP | 2003-297154 | A | 10/2003 |
| JP | 2008-226564 | A | 9/2008 |

* cited by examiner

*Primary Examiner* — Hoa C Nguyen
*Assistant Examiner* — Amol Patel
(74) *Attorney, Agent, or Firm* — McGinn IP Law Group, PLLC

(57) ABSTRACT

A differential signal transmission cable includes a pair of differential signal lines arranged in parallel to each other, an insulation for bundle-covering the pair of differential signal lines, and a shield conductor wound around an outer periphery of the insulation. The insulation is configured such that an outer circumference thereof in a cross section perpendicular to a longitudinal direction thereof has an oval shape formed with a continuous convex arc-curve. The oval shape has a width in a first direction along the arrangement direction of the pair of differential signal lines being larger than a width in a second direction orthogonal to the first direction.

12 Claims, 9 Drawing Sheets

DIFFERENTIAL SIGNAL TRANSMISSION CABLE

The present application is based on Japanese patent application No 2012-000529 filed on Jan. 5, 2012, the entire contents of which are incorporated herein by reference.

BACKGROUND OF THE INVENTION

1. Field of the Invention

The invention relates to a differential signal transmission cable.

2. Description of the Related Art

As a conventional technique, a parallel two-core shielded wire is known in which a shield conductor is formed by winding a metal foil tape around a pair of insulated wires arranged in parallel and at least one drain conductor arranged in parallel thereto all together, and an outer periphery of the shield conductor is covered by a jacket (see, e.g., JP-A-2002-289047).

In the parallel two-core shielded wire described in JP-A-2002-289047, it is possible to reduce manufacturing time since the shield conductor is formed by winding the metal foil tape.

SUMMARY OF THE INVENTION

In the parallel two-core shielded wire according to JP-A-2002-289047, a portion of the metal foil tape is flat in a transverse cross section. Pressure for pressing the metal foil tape based on tension is not generated in the flat portion since a tension direction of the metal foil tape is parallel to the surface of the flat portion, and the metal foil tape is likely to be loosened. The conventional parallel two-core shielded wire has a problem that skew and differential-to-common mode conversion quantity (i.e., conversion quantity from differential mode to common mode) may increase due to the loosening of the metal foil tape.

Accordingly, it is an object of the invention to provide a differential signal transmission cable that allows suppression of an increase in skew and differential-to-common mode conversion quantity.

(1) According to one embodiment of the invention, a differential signal transmission cable comprises:

a pair of differential signal lines arranged in parallel to each other;

an insulation for bundle-covering the pair of differential signal lines; and a shield conductor wound around an outer periphery of the insulation, wherein the insulation is configured such that an outer circumference thereof in a cross section perpendicular to a longitudinal direction thereof has an oval shape formed with a continuous convex arc-curve, and wherein the oval shape has a width in a first direction along the arrangement direction of the pair of differential signal lines being larger than a width in a second direction orthogonal to the first direction.

In the above embodiment (1) of the invention, the following modifications and changes can be made.

(i) The insulation is configured such that the minimum value of a curvature radius of the outer circumference shape is not less than 1/20 and not more than 1/4 of the maximum value of the curvature radius of the outer circumference.

(ii) The outer circumference of the insulation has an elliptical shape, and wherein the elliptical shape has a minor axis not less than 0.37 times and not more than 0.63 times a major axis thereof.

(iii) The outer circumference of the insulation comprises a first curved portion with a pair of symmetrical elliptical arcs located at both ends in the first direction and a second curved portion with a pair of symmetrical elliptical arcs located at both ends in the second direction, and wherein the cable satisfies a condition represented by the following formula (1):

$$\tan\phi_0 = \frac{a_1 b_2}{a_2 b_1}\tan\theta_0 \qquad \text{formula (1)}$$

where a minor or major axis of the elliptical arc of the first curved portion in the first direction is $2a_1$, a major or minor axis of the elliptical arc of the first curved portion in the second direction is $2b_1$, a major axis of the elliptical arc of the second curved portion in the first direction is $2a_2$, a minor axis of the elliptical arc of the second curved portion in the second direction is $2b_2$, a phase angle of a connecting point between the elliptical arc of the first curved portion and the second curved portion is $\theta_0$ and a phase angle of a connecting point between the elliptical arc of the second curved portion and the first curved portion is $\phi_0$.

(iv) The $a_2$ is larger than any one of the $a_1$, the $b_1$ and the $b_2$ (v) The $a_1$, the $b_1$ and the $b_2$ are a common value.

(vi) The differential signal transmission cable further comprises:

a covering member for covering a shield conductor, wherein the shield conductor comprises an insulating member and a conductive film on a surface of the insulating member opposite the covering member.

(vii) The shield conductor comprises a joint or an overlapped region along a longitudinal direction of the insulation, and wherein the covering member comprises a spiral joint or overlapped region on the shield conductor.

(viii) The shield conductor comprises a spiral joint or overlapped region on the insulation, and wherein the covering member comprises a braid.

(ix) The insulation comprises a foamed material.

(x) The insulation comprises an outer layer having a degree of foaming lower than that of an internal portion.

POINTS OF THE INVENTION

According to one embodiment of the invention, a differential signal transmission cable is configured such that an insulation thereof has an outer periphery of the cross section formed with a combination of plural curves each having different curvature radii (i.e., the cross section of the insulation being formed oval). Thus, pressure P can be constantly applied to the insulation so as to suppress the loosening of a binding tape even if an insulated wire covered by the insulation moves at the time of winding a metal foil tape around the insulation or tension T of the binding tape becomes less than a predetermined tension.

BRIEF DESCRIPTION OF THE DRAWINGS

Next, the present invention will be explained in more detail in conjunction with appended drawings, wherein:

FIGS. 8A and 8B are diagrams illustrating an outer circumferential shape of a cross section of a differential signal transmission cable in Comparative Example 3, wherein FIG. 8A is an overall view of the outer circumferential shape and FIG. 8B is a partial enlarged view thereof.

DETAILED DESCRIPTION OF THE PREFERRED EMBODIMENTS

Summary of Embodiments

A differential signal transmission cable in embodiments includes a pair of differential signal lines arranged in parallel to each other, an insulation for bundle-covering the pair of differential signal lines, and a shield conductor wound around an outer periphery of the insulation, wherein the insulation is configured such that an outer circumference thereof in a cross section perpendicular to a longitudinal direction thereof has an oval shape formed with a continuous convex arc-curve, and wherein the oval shape has a width in a first direction along the arrangement direction of the pair of differential signal lines being larger than a width in a second direction orthogonal to the first direction.

First Embodiment

Structural Outline of Differential Signal Transmission Cable 1

Figure 1:
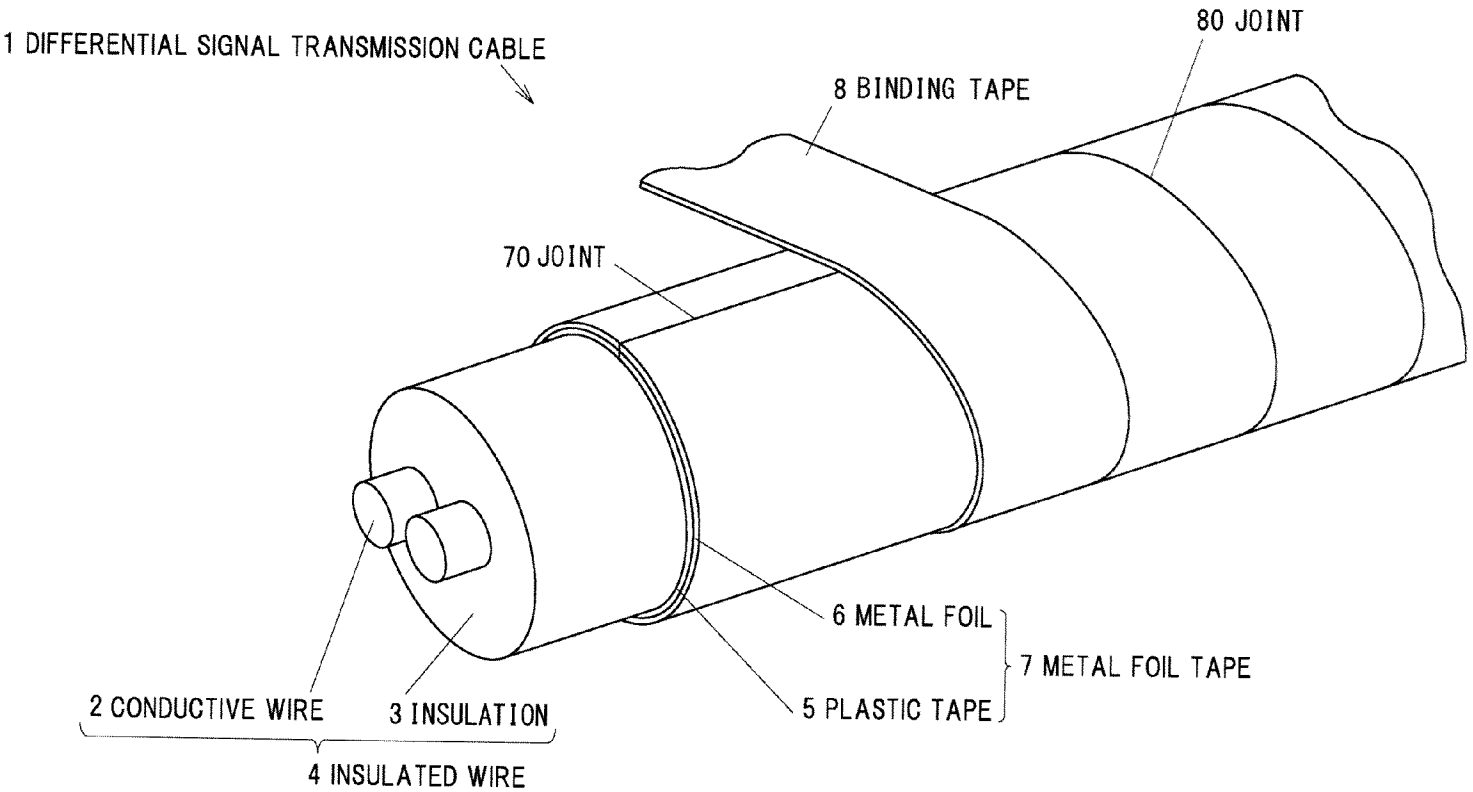
FIG. 1 is a perspective view showing a differential signal transmission cable in a first embodiment.
Figure 2A:
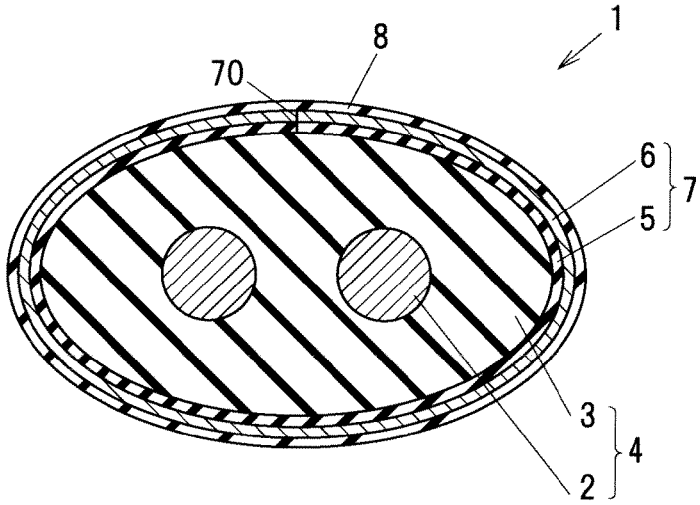
FIG. 2A is a cross sectional view showing the differential signal transmission cable in the first embodiment which is cut in a transverse direction and FIG. 2B is a schematic diagram illustrating a cross section of the differential signal transmission cable which is cut in a transverse direction.
Figure 2B:
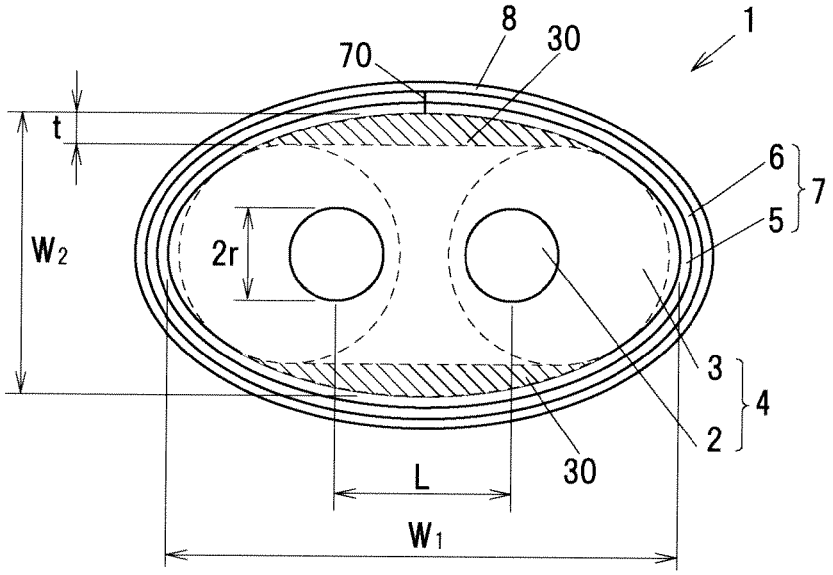

FIG. 1 is a perspective view showing a differential signal transmission cable 1 in a first embodiment. FIG. 2A is a cross sectional view showing the differential signal transmission cable 1 in the first embodiment which is cut in a transverse direction (a direction perpendicular to a longitudinal direction) and FIG. 2B is a schematic diagram illustrating a cross section of the differential signal transmission cable 1 which is cut in a transverse direction. Two circles indicated by a dotted line in FIG. 2B are to facilitate explanations and show cross sectional shapes of insulated wires which are used for making a cable having a transverse cross sectional shape equivalent to that of the differential signal transmission cable 1. Hereinafter, a cross section means a cross section which is cut in a transverse direction unless otherwise indicated.

The differential signal transmission cable 1 is, e.g., a cable for transmitting differential signals between or within electronic devices such as server, router and storage, etc., using a differential signal of not less than 10 Gbps.

The differential signal transmission is that signals having a phase difference of 180° are respectively transmitted in a pair of conductive wires and a difference between the two signals having different phases is extracted at a receiver. Since direction of the currents flowing in the pair of conductive wires are opposite to each other, an electromagnetic wave radiated from the conductive wire as a transmission path in which the current is flowing is small. In addition, since noise induced from the outside is equally superimposed on the two conductive wires in the differential signal transmission, it is possible to eliminate the noise by extracting a difference.

As shown in FIG. 1, the differential signal transmission cable 1 in the first embodiment is schematically configured to include, e.g., a pair of conductive wires 2 (differential signal lines) arranged in parallel at a distance, an insulation 3 covering the pair of conductive wires 2 so that an outer circumferential shape of a transverse cross section thereof is formed by combining plural curved lines having different curvature radii, and a metal foil tape 7 as a shield conductor wound around the insulation 3 so that an inner circumferential shape of a transverse cross section thereof is formed by combining plural curved lines in accordance with the outer circumferential shape of the insulation 3.

The pair of conductive wires 2 are arranged in parallel to each other. The insulation 3 covers the pair of conductive wires 2 together. In addition, the metal foil tape 7 is wound around an outer periphery of the insulation 3. The outer circumferential shape of the insulation 3 on a cross section perpendicular to a longitudinal direction thereof is an oval shape of a continuous convex arc-curve in which a diameter in a first direction along a parallel direction of the pair of conductive wires 2 is larger than a diameter in a second direction orthogonal to the first direction. In other words, the outer circumferential shape of the insulation 3 is a shape formed of an entirely smoothly continued convex surface without flat or recessed portions.

In addition, the differential signal transmission cable 1 in the first embodiment is provided with, e.g., a binding tape 8 as a covering member for covering the metal foil tape 7 which is provided with a plastic tape 5 as an insulating member and a metal foil 6 as a conducting layer provided on a surface of the plastic tape 5 opposite to a surface facing the insulation 3 (i.e., on a surface facing the binding tape 8).

The conductive wire 2 is, e.g., a solid wire of good electrical conductor such as copper or a solid wire of the electrical conductor which is plated, etc. In addition, a diameter 2*r* of the conductive wire 2 is, e.g., 0.511 mm. Furthermore, a distance L between the conductive wire 2 and another conductive wire 2 is, e.g., 0.99 mm. The distance L is a distance in the cross section between the center of the conductive wire 2 and the center of the other conductive wire 2. Alternatively, a twisted wire formed by twisting plural conductive wires may be used as the conductive wire 2 when, e.g., flexing characteristics are important.

The insulation 3 is formed of, e.g., a material having small relative permittivity and dielectric loss tangent. The material is, e.g., polytetrafluoroethylene (PTFE), perfluoroalkoxy (PFA) and polyethylene, etc. Alternatively, the insulation 3 may be formed of a foam insulation resin as a foamed material in order to reduce the relative permittivity and dielectric loss tangent. When, e.g., the foam insulation resin is used, the insulation 3 is formed by, e.g., a method in which a foaming agent is kneaded into a resin and a degree of foaming is controlled by a temperature at the time of molding, or by a method in which a gas such as nitrogen is injected at a forming pressure and foams are created by releasing the pressure.

The insulation 3 has, e.g., a substantially ellipse (oval) cross sectional shape as shown in FIG. 2B, in which, e.g., a width $W_1$ in a major axis direction (a first direction along a parallel direction of the pair of conductive wires 2) is 2.8 mm and a width $W_2$ in a minor axis direction (a second direction orthogonal to the first direction) is 1.54 mm. The width $W_1$ is greater than the width $W_2$ ($W_1>W_2$) and the width $W_1$ is about 1.8 times the width $W_2$ in the first embodiment.

Meanwhile, the insulation 3 has a region 30 (a region indicated by shading) surrounded by, e.g., a surface connecting tops of the two circles (not oval but perfect circles) indicated by a dotted line in FIG. 2B and a portion of an outer periphery of the insulation 3. The circle indicated by a dotted line is, e.g., an inscribed circle in contact with the outer periphery of the cross section of the insulation 3. When assuming that the two circles indicated by a dotted line in FIG. 2B are, e.g., insulated wires, the region 30 indicates a region of the insulation 3 which is not formed in an insulation covering the two insulated wires. The maximum width-t of the region 30 is, e.g., 0.07 mm. The cross sectional shape of the insulation 3 will be further described below in reference to Comparative Examples 1 and 2.

Figure 3A:
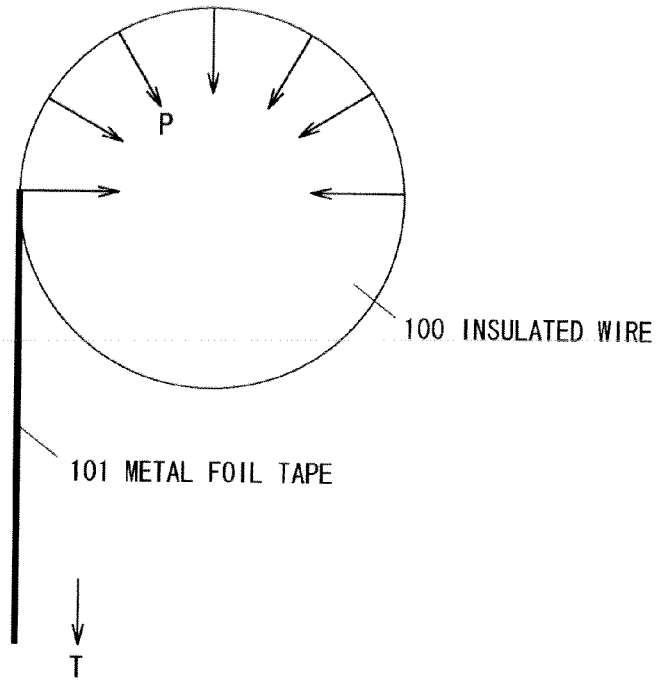
FIG. 3A is a schematic diagram illustrating a relation between tension T and pressure P when a binding tape is wound around an insulated wire having a circular cross section in Comparative Example 1 and FIG. 3B is a schematic diagram illustrating a relation between tension T and pressure P when a binding tape is wound around an insulated wire having a flat portion in Comparative Example 2.
Figure 3B:
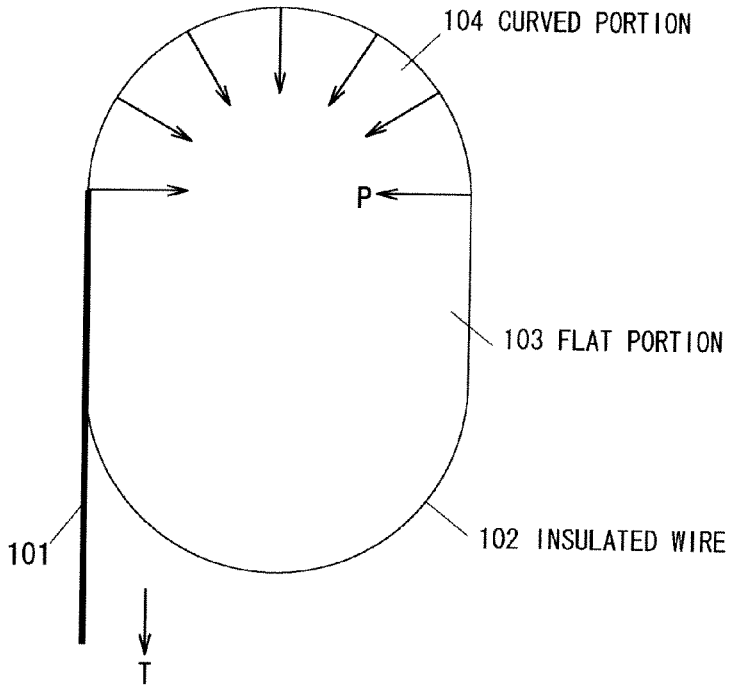

FIG. 3A is a schematic diagram illustrating a relation between tension T and pressure P when a metal foil tape 101 is wound around an insulated wire 100 having a circular cross section in Comparative Example 1 and FIG. 3B is a schematic diagram illustrating a relation between tension T and pressure P when the metal foil tape 101 is wound around an insulated wire 102 having a flat portion 103 in Comparative Example 2.

Here, it is necessary to reduce skew in the differential signal transmission cable 1 in order to transmit high-speed signal of several Gbps. The skew means an arrival time difference of differential signals (i.e., intra-pair skew).

When two insulated wires are used to form a cable, skew occurs due to a slight difference of permittivity within an insulation, a slight difference in outer diameter of the insulation, a slight misalignment of a drain wire running side by side in a longitudinal direction of the insulation, or a gap at an interface between the insulation and a metal foil tape caused by looseness of the metal foil tape provided on the outside of the insulation, etc.

In addition, for the necessity of reducing EMI (Electro-Magnetic Interference), differential-to-common mode conversion quantity needs to be suppressed to be low in the differential signal transmission cable 1. If a (left-right) symmetric property of the cable is not good, a portion of the inputted differential signals is converted into a common-mode signal. A rate of conversion into a common-mode is called differential-to-common mode conversion quantity. Particularly, a ratio of the common-mode signal in a port 2 to the differential signal in a port 1 can be measured as an S-parameter and is represented by "Scd21".

A known method of reducing skew is to cover two conductors together with an insulation to suppress a difference of permittivity within the insulation. Meanwhile, another method is also known in which a shield is relatively separated from a conductor by winding an insulation tape around two insulated wires before being covered by a shielding conductive material to enhance electromagnetic coupling between the conductors, thereby forming a cable in which skew is less likely to occur.

The method of reducing skew described above has a certain effect on skew caused by the difference of permittivity within the insulation, where skew is reduced by a combination of a certain outer circumferential shape of the insulation and prevention of misalignment of the conductor.

However, influence of the gap generated by looseness of a metal foil tape wound around the insulation still slightly remains even after taking the measures described above. Especially when gaps are generated at positions asymmetric with respect to a pair of conductors, an arrival time difference of common-mode signal occurs, a degree of influence on the arrival time of differential signals becomes different in the pair of conductors, and skew is thus likely to occur. When the differential signal transmission cable 1 is used as, e.g., a cable for transmitting high-speed signals equivalent to 10 Gbps, there is a problem of a decrease in yield due to the gap.

The looseness of the metal foil tape occurs either, e.g., in the case of winding a metal foil tape around an insulation or in the case of lengthwise disposing a metal foil tape and then winding a binding tape therearound.

The cause of looseness occurred in the wound metal foil tape is that, e.g., a force of pressing the insulation by the metal foil tape, i.e., pressure P applied to the insulation from the metal foil tape is small.

As shown in FIG. 3A, in the case of Comparative Example 1 in which the metal foil tape 101 is wound around the insulated wire 100 having a circular cross section, a force acts on the insulated wire 100 so as to balance out tension T.

This force is the pressure P applied to a side face of the insulated wire 100 and has a relation represented by $P=T/(2wr_1)$ (w: width of the metal foil tape 101, $r_1$: radius of the insulated wire 100).

On the other hand, in the case of Comparative Example 2 in which the metal foil tape 101 is wound around the insulated wire 102 having a cross sectional shape formed by combining the flat portions 103 and curved portions 104 as shown in FIG. 3B, the same pressure as P represented by $P=T/(2wr_1)$ is applied to the curved portions 104. However, since a direction of the tension T of the metal foil tape 101 is parallel to a surface of the flat portion 103, the pressure P applied to the flat portion 103 based on the tension T is zero.

Here, when the metal foil tape 101 is wound, a portion in which the metal foil tape 101 is straight is present both in the cross section formed by arranging two circular insulated wires and in the cross section formed by combining the flat portions 103 and the curved portions 104 as is shown in FIG. 3B.

That is, in the case of Comparative Example 2, since the tension T of the metal foil tape 101 is parallel to the surface of the flat portion 103 at the time of winding the metal foil tape 101, a force does not act on the flat portion 103. On the flat portion 103, looseness of the metal foil tape 101 to be wound occurs by slight movement of the differential signal transmission cable at the time of winding the metal foil tape 101 or slight change in tension of the metal foil tape 101, etc. This results in occurrence of skew and an increase in differential-to-common mode conversion quantity.

Accordingly, in the insulation 3 of the first embodiment, the regions 30 indicated by shading in FIG. 2B are provided on upper and lower sides in FIG. 2B. Therefore, since the direction of the tension T of the metal foil tape 7 is at any portions not parallel to the surface of the flat portion 103, vectors of the pressure P generated by winding the metal foil tape 7 are not zero.

The plastic tape 5 of the metal foil tape 7 is formed of, e.g., a resin material such as polyethylene.

The metal foil 6 of the metal foil tape 7 is formed by, e.g., adhering copper or aluminum to a surface of the plastic tape 5.

In addition, the metal foil tape 7 has a joint or an overlapped region along a longitudinal direction of the insulation 3. The metal foil tape 7 in the first embodiment is, e.g., tobacco-rolled so as to cover the insulation 3 of an insulated wire 4. The tobacco-rolling is a method in which the metal foil tape 7 is placed in a longitudinal direction of the insulation 3 and is wound around the insulation 3 only once from the longitudinal side thereof. A joint 70 shown in FIG. 1 is created along the longitudinal direction by, e.g., butting a longitudinal edge of the metal foil tape 7 against another edge. Meanwhile, when the metal foil tape 7 is longer than the outer periphery of the insulation 3 in the transverse direction, a region where an edge of the metal foil tape 7 overlaps another edge is created. Here, the metal foil tape 7 is wound around the insulation 3. Therefore, an inner circumferential shape of the cross section of the metal foil tape 7 is a similar shape to the insulation 3 as shown in FIGS. 2A and 2B.

The binding tape 8 is formed of, e.g., a resin material.

The binding tape 8 has a spiral joint or overlapped region on the metal foil tape 7. The binding tape 8 in the first embodiment is, e.g., spirally wound so as to cover the metal foil tape 7. The binding tape 8 is wound around the insulation 3 so that a widthwise edge does not overlap another widthwise edge. Therefore, a joint 80 shown in FIG. 1 is spirally formed on the metal foil tape 7. When wound around the metal foil tape 7 so that one edge of the binding tape 8 overlaps another edge, an overlapped region on the metal foil tape 7 is spirally formed.

A method of manufacturing the differential signal transmission cable 1 in the first embodiment will be described below.

Method of Manufacturing Differential Signal Transmission Cable 1

Firstly, the insulated wire 4 is formed by covering a pair of conductive wires 2 with the insulation 3. In detail, the conductive wires 2 are arranged in parallel at a distance. As an example, the pair of conductive wires 2 is arranged in parallel at a distance of 0.99 mm. In addition, a diameter 2*r* of the conductive wire 2 is, e.g., 0.511 mm. Then, the insulation 3 is formed by covering the pair of conductive wires 2 with expanded polyethylene. The insulation 3 is formed so as to have relative permittivity of, e.g., 1.5 by controlling a degree of foaming.

Meanwhile, the insulation 3 has a shape consisting of plural curved lines having different curvature radii as shown in FIG. 2B and, for example, the width $W_1$ in a major axis direction is 2.8 mm and the width $W_2$ in a minor axis direction is 1.54 mm. Here, the maximum width-t of the region 30 is, e g, 0.07 mm. The curvature radius of the region 30 is, e g, 7 mm.

For forming the insulation 3, for example, an extrusion die of an extruder is formed according to the shape of the insulation 3 and expanded polyethylene is extruded together with a pair of conductive wires 2 from the extrusion die.

Next, the metal foil tape 7 is placed in a longitudinal direction of the insulated wire 4 and is wound around the insulated wire 4. The winding is carried out so that the plastic tape 5 faces the insulation 3 and the metal foil 6 is exposed to the outside. The metal foil 6 is exposed to the outside since soldering is carried out in a later process.

Then, the binding tape 8 is spirally wound around the metal foil tape 7 and predetermined processes are then performed, thereby obtaining the differential signal transmission cable 1.

Relation Between Curvature Radius and Looseness of Metal Foil Tape 7

Figure 4:
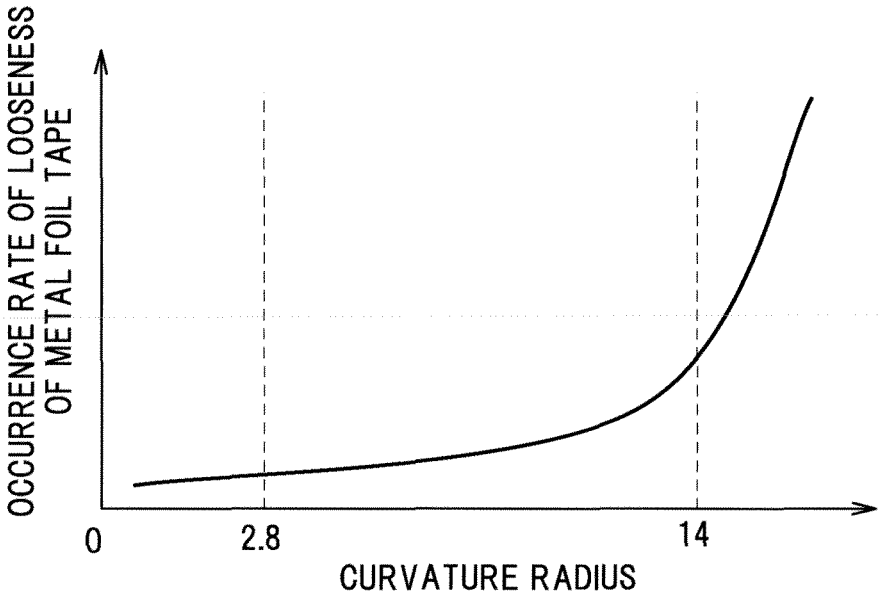
FIG. 4 is a graph showing a relation between a curvature radius and an occurrence rate of looseness of metal foil tape in the differential signal transmission cable in the first embodiment.

FIG. 4 is a graph showing a relation between a curvature radius and an occurrence rate of looseness of metal foil tape in the differential signal transmission cable having a shape shown in FIGS. 2A and 2B. In FIG. 4, the horizontal axis is a curvature radius and the vertical axis is an occurrence rate of looseness of the metal foil tape 7. The occurrence rate of looseness of the metal foil tape 7 means a probability that a gap is generated between the insulation 3 and the metal foil tape 7 in a cross section over the entire manufactured cable.

The occurrence rate of looseness of the metal foil tape 7 is measured by the following method. Firstly, samples of the cable are taken from the entire length of the manufactured cable without bias and a cross section of the cable is each observed. Presence of gap between the insulation 3 and the metal foil tape 7 in each sample is checked and a ratio of the number of the samples with a gap to the total number of the samples is defined as an occurrence rate of looseness.

According to the measurement result shown in FIG. 4, when the curvature radius of the region 30 of the insulation 3 is not more than 14 mm (20 times the curvature radius of the curved line located in a major axis direction), the occurrence rate of looseness of the metal foil tape 7 is not more than several % and it is possible to maintain performance of the differential signal transmission cable 1.

On the other hand, when the curvature radius of the region 30 is 2.8 mm (4 times the curvature radius of the curved line located in a major axis direction), the thickness of the region 30 increases about 0.25 mm even though the occurrence rate of looseness of the metal foil tape 7 is low. The increase in the thickness of the region 30 increases characteristic impedance of the differential signal transmission cable 1. In addition, when the differential signal transmission cable 1 is manufactured so as to have a curvature radius of 2.8 mm, an outer diameter of a cable which is formed by twisting plural differential signal transmission cables becomes large and it is difficult to handle. Therefore, the preferred range of the curvature radius is 4 times to 20 times.

Effects of the First Embodiment

In the differential signal transmission cable 1 of the first embodiment, it is possible to suppress skew and differential-to-common mode conversion quantity. In detail, an outer periphery of the cross section of the insulation 3 is a combination of plural curved lines having different curvature radii, i.e., is configured to include curved lines having a curvature radius of 0.7 mm located in a major axis direction and the regions 30 having a curvature radius of 7 mm as shown in FIG. 2B. Therefore, in the differential signal transmission cable 1, the pressure P is constantly applied to the surface of the insulation 3 so as to balance out the tension T of the metal foil tape 7 at the time of winding the binding tape 8 around the insulated wire 4. The pressure P in the region 30 decreases to about 1/10 of that in the major axis direction, which is considered because the pressure P is inversely proportional to the curvature radius of the outer periphery of the cross section when the tension T is constant, while the pressure P is not applied to the insulation 3 in a linear portion when the region 30 is not formed in the insulation 3 as described above.

In addition, since the region 30 is formed in the insulation 3 in the first embodiment, the pressure P is constantly applied to the insulation 3 and it is possible to suppress occurrence of looseness of the binding tape 8 even if the insulated wire 4 moves at the time of winding the metal foil tape 7 around the insulation 3 or the tension T of the binding tape 8 becomes weaker than a predetermined tension. Accordingly, it is possible to suppress looseness of the metal foil tape 7 and it is thus possible to suppress formation of a gap at an interface between the insulation 3 and the metal foil tape 7. Therefore, a decrease in performance caused by an increase in skew and differential-to-common mode conversion quantity can be suppressed in the differential signal transmission cable 1 of the first embodiment.

Second Embodiment

The second embodiment is different from the first embodiment in that the outer circumferential shape of the transverse cross section of the insulation 3 is an ellipse shape.

Figure 5A:
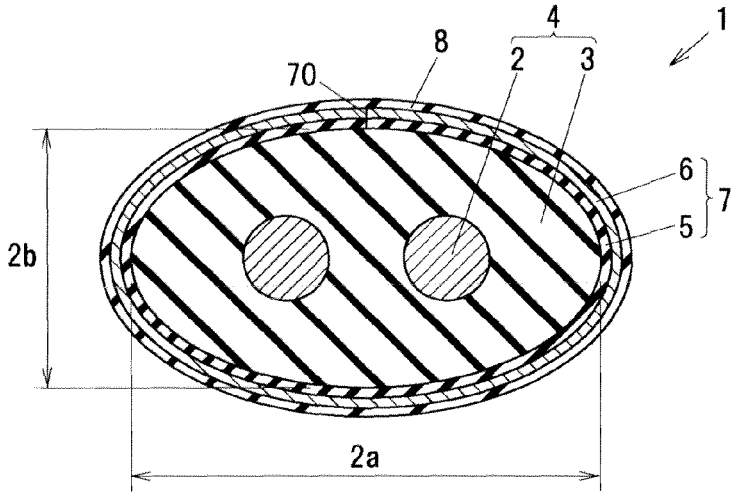
FIG. 5A is a cross sectional view showing a differential signal transmission cable in a second embodiment and FIG. 5B is a diagram relating to the maximum value and the minimum value of curvature radius.
Figure 5B:
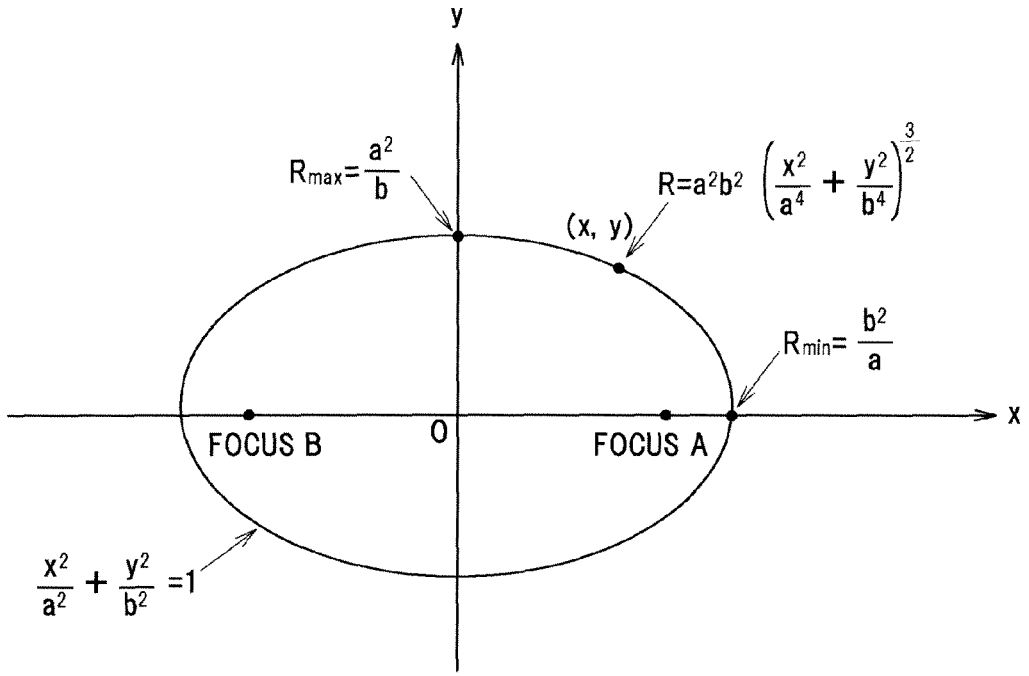

FIG. 5A is a transverse cross sectional view showing a differential signal transmission cable 1 in a second embodiment and FIG. 5B is a diagram relating to the maximum value and the minimum value of curvature radius. In FIG. 5B, the horizontal axis is the x-axis and the vertical axis is the y-axis. In the ellipse, a major axis is on the x-axis and a minor axis is on the y-axis. It should be noted that, in each of the following embodiments, portions having the same structure and function as those in the first embodiment are denoted by the same reference numerals and explanations thereof will be omitted.

In the differential signal transmission cable 1 of the second embodiment, the outer circumferential shape of the insulation 3 is an ellipse shape having foci A and B. Other configurations are the same as the differential signal transmission cable 1 in the first embodiment.

Meanwhile, the method of manufacturing the differential signal transmission cable 1 in the second embodiment is different from that in the first embodiment in that the insulation 3 is formed in an ellipse shape having a major axis (=2*a*) of 3.20 mm and a minor axis (=2*b*) of 1.64 mm.

In the differential signal transmission cable 1 in the second embodiment, the pressure P is constantly applied to the insulation 3 at the time of winding the binding tape 8 around the metal foil tape 7. In addition, a vector of the pressure P applied to the insulation 3 by the metal foil tape 7 is directed to either the focus A or the focus B which are shown in FIG. 5B.

When the tension T of the metal foil tape 7 is constant, the pressure P is inversely proportional to the curvature radius of the outer periphery of the cross section of the insulation 3 as described above. Accordingly, when an ellipse having the major axis 2*a* and the minor axis 2*b* as shown in FIG. 5A is represented by the formula (2), the curvature radius at a given point (x, y) on the elliptical curve line is represented by the formula (3).

$$\frac{x^2}{a^2} + \frac{y^2}{b^2} = 1 \qquad \text{formula (2)}$$

$$R = a^2b^2\left(\frac{x^2}{a^4} + \frac{y^2}{b^4}\right)^{\frac{3}{2}} \qquad \text{formula (3)}$$

According to the formula (3), it is understood that the curvature radius varies in a range of not less than $b^2/a$ and not more than $a^2/b$. Therefore, the minimum value of the pressure P is $(b/a)^3$ times the maximum value, i.e., the pressure P on the minor axis decreases to about 13% in the shape of the second embodiment.

However, since the metal foil tape 7 in the differential signal transmission cable 1 of the second embodiment can be wound so that pressure is constantly applied to the insulation 3 in the same manner as the first embodiment, it is possible to suppress occurrence of looseness of the binding tape 8 even if the insulated wire 4 moves at the time of winding the metal foil tape 7 around the insulation 3 or the tension T of the binding tape 8 becomes weaker than a predetermined tension.

Accordingly, it is possible to suppress looseness of the metal foil tape 7 and it is thus possible to suppress formation of a gap at the interface between the insulation 3 and the metal foil tape 7. In addition, since a portion in which the curvature radius sharply varies is not present, a rate of generation of a gap is smaller than the first embodiment. Therefore, a decrease in performance caused by an increase in skew and differential-to-common mode conversion quantity can be suppressed in the differential signal transmission cable 1 of the second embodiment.

A ratio of the minimum to maximum curvature radii is $(b/a)^3$ as described above. Therefore, the curvature radius is not less than 1/20 and not more than 1/4 when the minor axis of the cross section of the insulation 3 is in a range of not less than 0.37 times and not more than 0.63 times the major axis, and if the curvature radius is within the above range, it is possible to suppress looseness of the metal foil tape 7 in the same manner as the first embodiment.

Third Embodiment

The third embodiment is different from the first and second embodiments in that a degree of foaming within the insulation 3 is different in an internal portion and in an outer peripheral portion.

Figure 6:
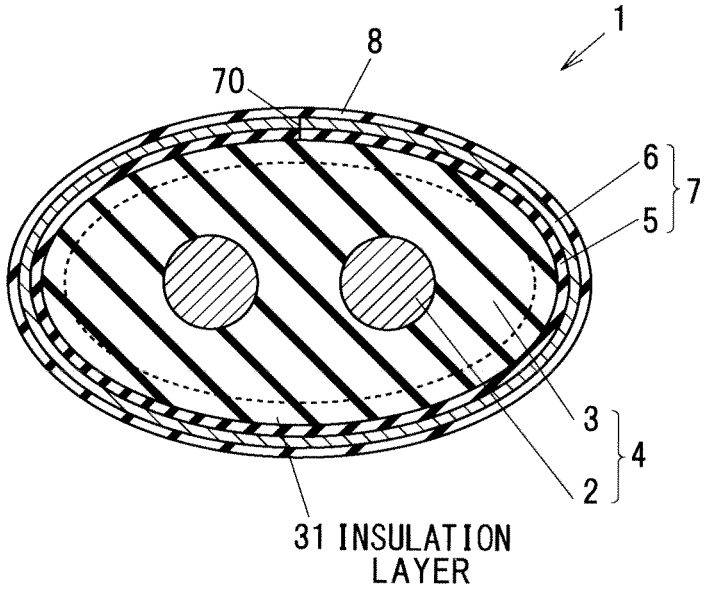
FIG. 6 is a cross sectional view showing a differential signal transmission cable in a third embodiment.

FIG. 6 is a cross sectional view showing a differential signal transmission cable in a third embodiment. In FIG. 6, a region surrounded by an outer periphery of the insulation 3 and a dotted line is an insulation layer 31.

In the differential signal transmission cable 1 of the third embodiment, a degree of foaming within the insulation 3 is different in an internal portion and in an outer peripheral portion. Other configurations are the same as the differential signal transmission cable 1 in the first embodiment. The degree of foaming is, e.g., 50% in the internal portion and several % in the insulation layer 31

The insulation layer 31 of the insulation 3 has a degree of foaming lower than that of the internal portion of the insulation 3. In other words, in the insulation 3, the outer peripheral portion is harder than the internal portion since the insulation layer 31 is formed.

Meanwhile, the method of manufacturing the differential signal transmission cable 1 in the third embodiment is to cover a pair of conductive wires 2 using an extruder in the same manner as the first and second embodiments and also includes an extrusion step of further covering the outermost periphery of the insulation 3 with the insulation layer 31 having a low degree of foaming. The remaining of the manufacturing method is the same as the first and second embodiments.

In the differential signal transmission cable 1 in the third embodiment, the shape of the insulation 3 is more stable than the differential signal transmission cables 1 in the first and second embodiments since the insulation layer 31 is formed on the outer peripheral portion, and the pressure P applied by the binding tape 8 acts on the insulation 3 more stably. As a result, it is possible to suppress looseness of the metal foil tape 7 and it is thus possible to suppress formation of a gap at the interface between the insulation 3 and the metal foil tape 7. Therefore, a decrease in performance caused by an increase in skew and differential-to-common mode conversion quantity can be suppressed in the differential signal transmission cable 1 of the third embodiment.

Fourth Embodiment

The fourth embodiment is different from the second embodiment in that the outer circumferential shape of the insulation 3 on a cross section perpendicular to a longitudinal direction consists of a first curved portion as a pair of elliptical arcs and a second curved portion as a pair of elliptical arcs which connects between the pair of elliptical arcs of the first curved portion. Here, an elliptical arc is defined as a concept including a circular arc as a portion of a perfect circle. In addition, an ellipse in the following description is a concept including a perfect circle.

Figure 7A:
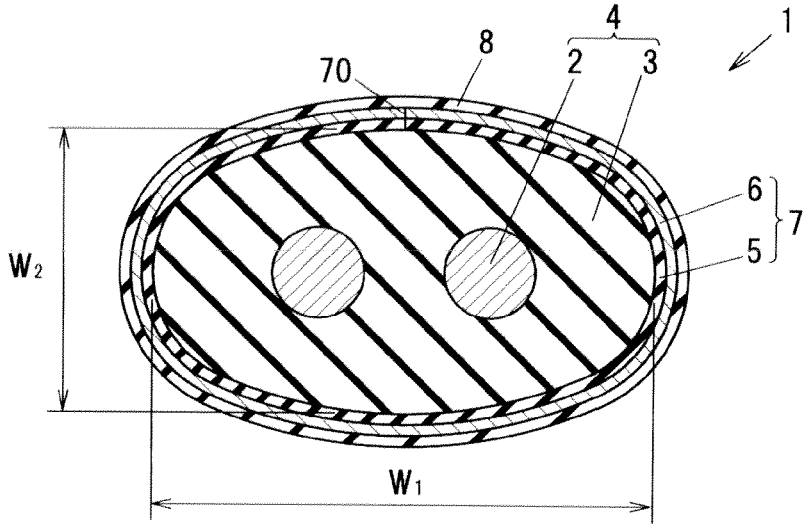
FIG. 7A is a cross sectional view showing a differential signal transmission cable in a fourth embodiment taken in a transverse direction which is perpendicular to a longitudinal direction and FIG. 7B is a diagram illustrating an outer circumferential shape of an insulation in FIG. 7A.
Figure 7B:
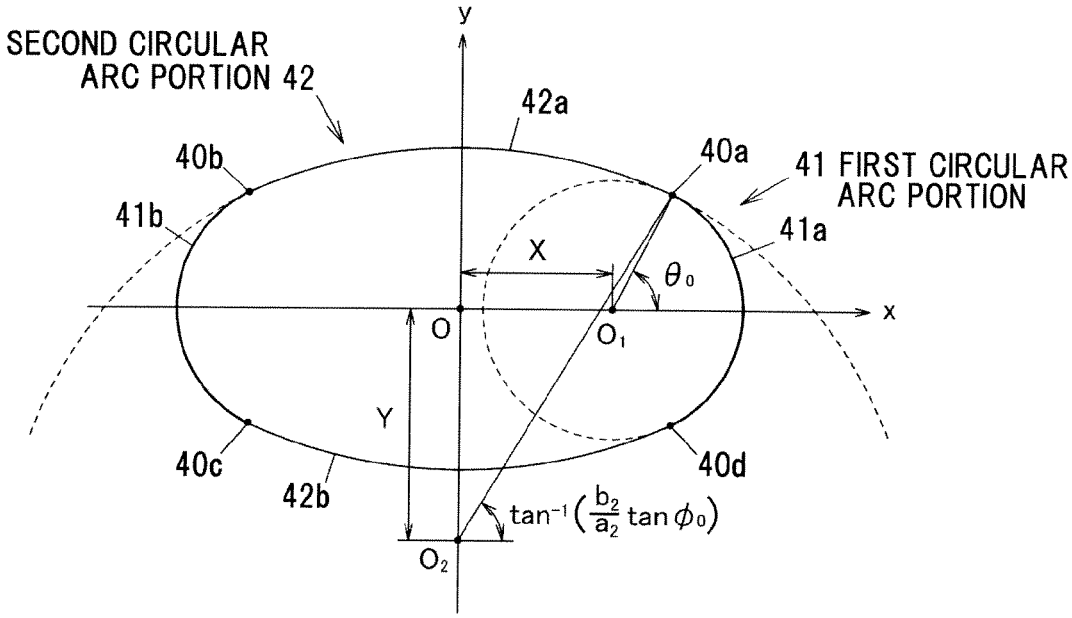

FIG. 7A is a cross sectional view showing a differential signal transmission cable 1 in a fourth embodiment taken in a transverse direction which is perpendicular to a longitudinal direction and FIG. 7B is a diagram illustrating an outer circumferential shape in a cross section of an insulation 3 of the differential signal transmission cable 1. In FIG. 7A, portions having the same structure and function as those in the first embodiment are denoted by the same reference numerals and explanations thereof will be omitted. Meanwhile, in FIG. 7B, the x-axis is a straight line passing through the respective centers of the pair of conductive wires 2, and the y-axis is a straight line which passes through an origin O (the middle position between the respective centers of the pair of conductive wires 2) indicating the center of the insulation 3 and is orthogonal to the x-axis.

A first curved portion (or first arc portion) 41 is composed of a pair of elliptical arcs 41*a*, 41*b* located at both ends in a first direction which is along a parallel direction of the pair of conductive wires 2 (a horizontal direction in FIGS. 7A and 7B). A second curved portion (or second arc portion) 42 is composed of a pair of elliptical arcs 42*a*, 42*b* located at both ends in a second direction (a vertical direction in FIGS. 7A and 7B) which is orthogonal to the first direction. The elliptical arcs 41*a* and 41*b* are line-symmetric with respect to the y-axis. The elliptical arcs 42*a* and 42*b* are line-symmetric with respect to the x-axis.

In FIG. 7B, a portion, other than the elliptical arc 41*a*, of an ellipse which includes the elliptical arc 41*a* is indicated by a dashed line (a line extended from the elliptical arc 41*a*) and a portion, other than the elliptical arc 42*a*, of an ellipse which includes the elliptical arc 42*a* is also indicated by a dashed line (a line extended from the elliptical arc 42*a*). As shown in FIG. 7B, the ellipse including the elliptical arc 41*a* is an inscribed circle in contact with the ellipse including the elliptical arc 42*a*.

The four elliptical arcs 41*a*, 41*b*, 42*a* and 42*b* are continued smoothly at respective connecting points 40*a* to 40*d*, i.e., without forming an angle at the connecting points 40*a* to 40*d*. In FIG. 7B which shows the outline of the insulation 3, the x-axis is the first direction and the y-axis is the second direction.

The elliptical arcs 41*a* and 41*b* of the first curved portion 41 are portions of an ellipse in which a minor or major axis in the first direction is $2a_1$ ($2a_1=a_1\times2$) and a major or minor axis in the second direction is $2b_1$ ($2b_1=b_1\times2$). Although the relation is $a_1=b_1$ and the elliptical arcs 41*a* and 41*b* are portions of a perfect circle in an example shown in FIG. 7B, the relation may be $a_1<b_1$. When the relation is $a_1<b_1$, each of the elliptical arcs 41*a* and 41*b* is a portion of an ellipse having a minor axis in the x-axis direction and a major axis in the y-axis direction. On the other hand, when the relation is $a_1>b_1$, each of the elliptical arcs 41*a* and 41*b* is a portion of an ellipse having a major axis in the x-axis direction and a minor axis in the y-axis direction.

The elliptical arcs 42*a* and 42*b* of the second curved portion 42 are portions of an ellipse in which a major axis in the first direction is $2a_2$ ($2a_2=a_2\times2$) and a minor axis in the second direction is $2b_2$ ($2b_2=b_2\times2$). $2a_2$ is larger than $2b_2$ ($2a_2>2b_2$), and each of the elliptical arcs 42*a* and 42*b* is a portion of an ellipse having a major axis in the x-axis direction and a minor axis in the y-axis direction.

In the fourth embodiment, the major axis $2a_2$ of the second curved portion 42 is larger than any of the major and minor axes $2a_1$ and $2b_1$ of the first curved portion 41 and the minor axis $2b_2$ of the second curved portion 42 ($a_2>a_1$, $a_2>b_1$ and $a_2>b_2$). In addition, the major and minor axes $2a_1$ and $2b_1$ of the first curved portion 41 and the minor axis $2b_2$ of the second curved portion 42 are common values to each other ($a_1=b_1=b_2$).

In addition, the entire outer circumferential shape of the insulation 3 in the fourth embodiment is an oval shape in which the width $W_1$ in the first direction is larger than the width $W_2$ in the second direction.

The elliptical arc 41*a* of the first curved portion 41 is an elliptical arc drawn by an orbit expressed by the following coordinate (1). In the coordinate (1), $\theta_0$ is a phase angle indicating one end (the connecting point 40*a*) of the elliptical arc 41*a* when viewed from a gravity center $O_1$ (a center point between two foci) of an ellipse including the elliptical arc 41*a*, and is an angle formed between a line segment connecting the gravity center $O_1$ to the connecting point 40*a* and the x-axis. Meanwhile, X is an offset of the elliptical arc 41*a* in the x-axis direction. The gravity center $O_1$ is on the x-axis, and a distance between the origin O and the gravity center $O_1$ is X.

$$(a_1 \cos\theta + X,\ b_1 \sin\theta)$$

$$(-\theta_0 \le \theta \le \theta_0) \qquad \text{coordinate (1)}$$

A locus of coordinate values when θ(°) in the coordinate (1) is varied from $-\theta_0$ to $+\theta_0$ is the elliptical arc 41*a*.

Meanwhile, the elliptical arc 41*b* of the first curved portion 41 is an elliptical arc drawn by an orbit expressed by the following coordinate (2) in which a direction of the offset indicated by X in the coordinate (1) is opposite.

$$(a_1 \cos\theta - X,\ b_1 \sin\theta)$$

$$(180° - \theta_0 \le \theta \le 180° + \theta_0) \qquad \text{coordinate (2)}$$

A locus of coordinate values when θ(°) in the coordinate (2) is varied from $180°-\theta_0$ to $180°+\theta_0$ is the elliptical arc 41*b*.

The elliptical arc 42*a* of the second curved portion 42 is an elliptical arc drawn by an orbit expressed by the following coordinate (3). In the coordinate (3), $\phi_0$ is a phase angle indicating one end (the connecting point 40*a*) of the elliptical arc 42*a* when viewed from a gravity center $O_2$ (a center point between two foci) of an ellipse including the elliptical arc 42*a*, and an angle formed between a line segment connecting the gravity center $O_2$ to the connecting point 40*a* and a straight line parallel to the x-axis is $$\tan^{-1}\left(\frac{b_2}{a_2}\tan\varphi_0\right) \qquad \text{coordinate (3)}$$

$$(a_2\cos\phi,\ b_2\sin\phi - Y)$$

$$(\phi_0 \le \phi \le 180° - \phi_0)$$

A locus of coordinate values when θ(°) in the coordinate (3) is varied from $\phi_0$ to $180°-\phi_0$ is the elliptical arc 42*a*.

Meanwhile, the elliptical arc 42*b* of the second curved portion 42 is an elliptical arc drawn by an orbit expressed by the following coordinate (4) in which a direction of the offset indicated by Y in the coordinate (3) is opposite.

$$(a_2 \cos \phi, b_2 \sin \phi + Y)$$

$$(180° + \phi_0 \leq \phi \leq 360° - \phi_0) \qquad \text{coordinate (4)}$$

A locus of coordinate values when $\phi$(°) in the coordinate (4) is varied from $180° + \phi_0$ to $360° - \phi_0$ is the elliptical arc 42*b*.

The conditions of X and Y under which plural elliptical arcs 41*a*, 41*b*, 42*a* and 42*b* expressed by the coordinates (1) to (4) are continued at each of the connecting points 40*a* to 40*d*, i.e., the conditions for connecting the first curved portion 41 to the second curved portion 42 without level difference are represented by the following formulas (4) and (5).

$$X = a_2 \cos \phi_0 - a_1 \cos \theta_0 \qquad \text{formula (4)}$$

$$Y = b_2 \sin \phi_0 - b_1 \sin \theta_0 \qquad \text{formula (5)}$$

In addition, the condition under which the elliptical arcs 41*a* and 42*a* are continued smoothly at the connecting point 40*a*, i.e., the condition for continuing without forming a raised or recessed portion at the connecting point 40*a* is represented by the following formula (6).

$$\tan\phi_0 = \frac{a_1 b_2}{a_2 b_1} \tan\theta_0 \qquad \text{formula (6)}$$

In addition, since the elliptical arcs 41*a* and 41*b* as well as the elliptical arcs 42*a* and 42*b* are each symmetrical, continuity between the elliptical arcs 42*a* and 41*b* at the connecting point 40*b*, between the elliptical arcs 41*b* and 42*b* at the connecting point 40*c* and between the elliptical arcs 42*b* and 41*a* at the connecting point 40*d* are respectively smooth when the formula (6) is satisfied. That is, the following formula (7) is satisfied at each of the connecting points 40*b*, 40*c* and 40*d* where $\theta = 180° - \theta_0$ as well as $\phi = 180° - \phi_0$, $\theta = 180° + \theta_0$ as well as $\phi = 180° + \phi_0$, and $\theta = 360° - \phi_0$ as well as $\phi = 360° - \phi_0$.

$$\tan\phi = \frac{a_1 b_2}{a_2 b_1} \tan\theta \qquad \text{formula (7)}$$

The insulation 3 of the differential signal transmission cable 1 in the fourth embodiment satisfies all of the formulas (4) to (6). As a result, the elliptical arcs 41*a*, 41*b*, 42*a* and 42*b* are continued smoothly at each of the connecting points 40*a* to 40*d*.

Comparative Example 3

Figure 8A:
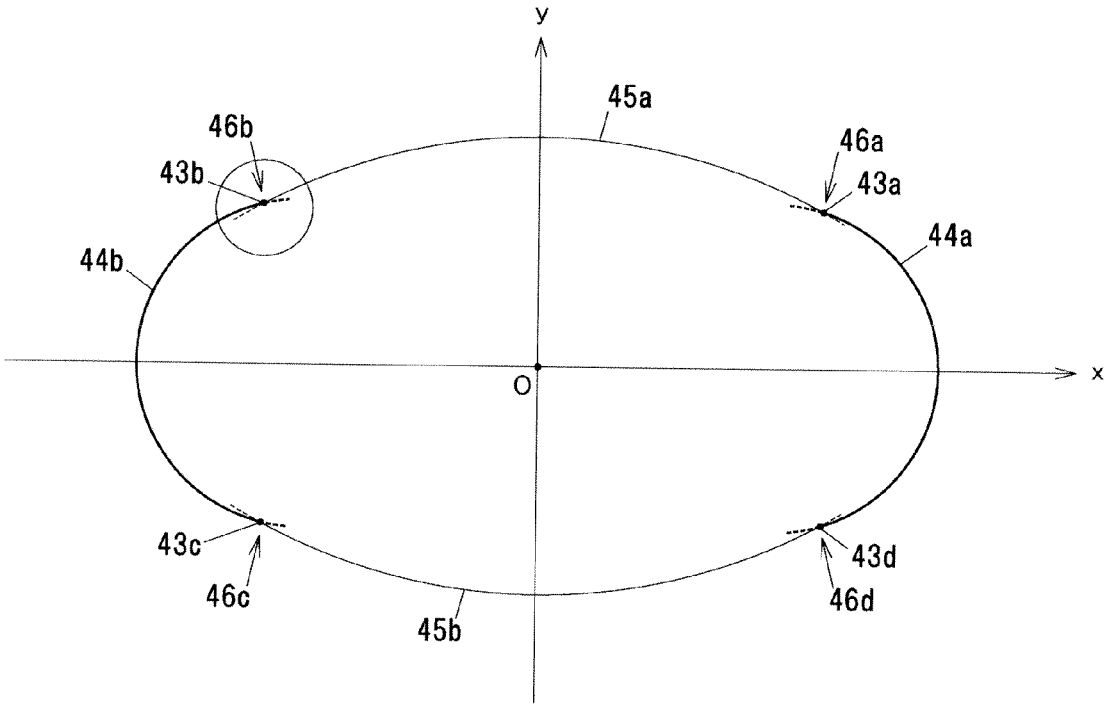
Figure 8B:
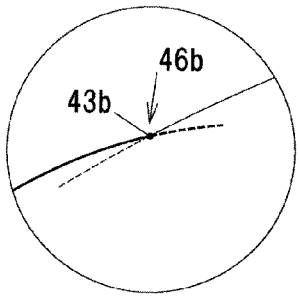

FIGS. 8A and 8B are diagrams illustrating an outer circumferential shape of a cross section of a differential signal transmission cable in Comparative Example 3, wherein FIG. 8A is an overall view of the outer circumferential shape and FIG. 8B is a partial enlarged view thereof.

Elliptical arcs 44*a*, 44*b*, 45*a* and 45*b* shown in Comparative Example 3 which are elliptical arcs expressed by the same coordinates as the coordinates (1) to (4) satisfy the conditions represented by the formulas (4) and (5) (the conditions for continuously connecting elliptical arcs) but do not satisfy the condition represented by the formula (6). Therefore, recessed portions 46*a* to 46*d* which are depressed inwardly are formed at connecting points 43*a* to 43*d* of the elliptical arcs 44*a*, 44*b*, 45*a* and 45*b*.

Accordingly, in the differential signal transmission cable of the Comparative Example 3, a gap is likely to be formed between the insulation 3 and the metal foil tape 7 wound therearound, which is a cause of an increase in skew and differential-to-common mode conversion quantity.

In the differential signal transmission cable 1 of the fourth embodiment, the outer circumferential shape of the insulation 3 satisfies the formula (6) in addition to the formulas (4) and (5), and thus, the first curved portion 41 and the second curved portion 42 are continued smoothly. In other words, since the outer circumferential shape of the insulation 3 of the differential signal transmission cable 1 in the fourth embodiment is formed of a convex curved line over the entire circumference, pressure due to winding is constantly applied to the insulation 3 at the time of winding the binding tape 8 around the metal foil tape 7 in the same manner as the first and second embodiments.

As described above, in the differential signal transmission cable 1 of the fourth embodiment, it is possible to wind the metal foil tape 7 no as to constantly apply pressure to the insulation 3 in the same manner as the first and second embodiments and it is thus possible to suppress looseness at the time of winding the metal foil tape 7 around the insulation 3. As a result, formation of a gap at the interface between the insulation 3 and the metal foil tape 7 can be suppressed, which suppresses occurrence of skew and differential-to-common mode conversion quantity.

Meanwhile, since variation (a difference between the maximum value and the minimum value) in the curvature radius can be reduced as compared to the second embodiment, probability of gap formation is much smaller. Therefore, a decrease in performance caused by an increase in skew and differential-to-common mode conversion quantity can be further suppressed in the differential signal transmission cable 1 of the fourth embodiment.

In addition, in the differential signal transmission cable 1 of the fourth embodiment, it is easier to ensure a distance between the conductive wire 2 and the insulation 3 than the case where the cross section of the insulation 3 is an ellipse shape as is in the second embodiment. Therefore, if a foamed material used in the third embodiment is used for the insulation 3, a degree of foaming is equalized and the yield is improved.

Modification

Figure 9:
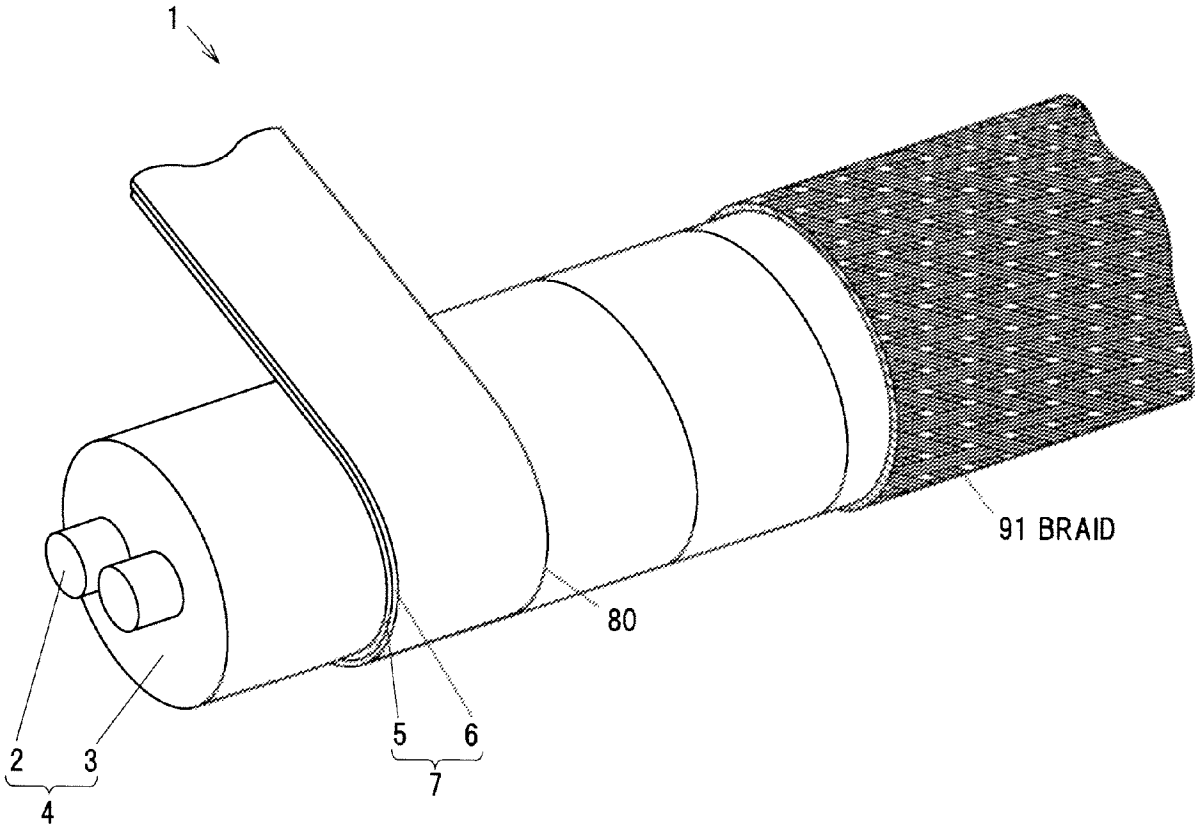
FIG. 9 is a perspective view showing a differential signal transmission cable in a modification.

FIG. 9 is a perspective view showing a differential signal transmission cable 1 in a modification. In the differential signal transmission cable 1 of the modification, the metal foil tape 7 has a spiral joint 80 on the insulation 3 and a covering member for covering the metal foil tape 7 is a braid 9. The metal foil tape 7 is formed by adhering a copper metal foil 6 on a surface of the plastic tape 5 and the braid 9 is composed of sixty-four copper strands each having a strand diameter of 0.08 mm.

In the differential signal transmission cable 1 in the modification, the insulation 3 has a shape described in any of the first to third embodiments and it is thus possible to suppress occurrence of looseness even if the metal foil tape 7 is spirally wound therearound. As a result, formation of a gap at the interface between the insulation 3 and the metal foil tape 7 can be suppressed. Therefore, a decrease in performance caused by an increase in skew and differential-to-common mode conversion quantity can be suppressed in the differential signal transmission cable 1 of the modification.

Alternatively, the metal foil tape 7 may have a spiral overlapped region on the insulation 3.

Although the embodiments and modification of the invention have been described, the invention according to claims is not to be limited to the above-mentioned embodiments and modification. Further, please note that not all combinations of the features described in the embodiments and modification are not necessary to solve the problem of the invention.

What is claimed is:

1. A differential signal transmission cable, comprising:

a pair of differential signal lines arranged in parallel to each other;

an insulation for bundle-covering the pair of differential signal lines; and a shield conductor wound around an outer periphery of the insulation, wherein the insulation is configured such that an outer circumference thereof in a cross section perpendicular to a longitudinal direction thereof has an oval shape formed with a continuous convex arc-curve, wherein the outer circumference of the insulation comprises a first curved portion with a pair of symmetrical elliptical arcs located at both ends in a first direction along the arrangement direction of the pair of differential signal lines and a second curved portion with a pair of symmetrical elliptical arcs located at both ends in a second direction orthogonal to the first directional, and wherein the cable satisfies a condition represented by the following formula (1) where a minor or major axis of the elliptical arc of the first curved portion in the first direction is $2a_1$, a major or minor axis of the elliptical arc of the first curved portion in the second direction is $2b_1$, a major axis of the elliptical arc of the second curved portion in the first direction is $2b_2$, a minor axis of the elliptical arc of the second curved portion in the second direction is $2b_2$, a phase angle of a connecting point between the elliptical arc of the first curved portion and the second curved portion is $\theta_0$ and a phase angle of a connecting point between the elliptical arc of the second curved portion and the first curved portion is $\phi_0$, $$\tan\phi_0 = \frac{a_1 b_2}{a_2 b_1}\tan\theta_0. \quad \text{formula (1)}$$

2. The differential signal transmission cable according to claim 1, wherein the insulation is configured such that the minimum value of a curvature radius of the outer circumference shape is not less than 1/20 and not more than 1/4 of the maximum value of the curvature radius of the outer circumference.

3. The differential signal transmission cable according to claim 2, wherein the outer circumference of the insulation has an elliptical shape, and wherein the elliptical shape has a minor axis not less than 0.37 times and not more than 0.63 times a major axis thereof.

4. The differential signal transmission cable according to claim 1, wherein the $a_2$ is larger than any one of the $a_1$, the $b_1$ and the $b_2$.

5. The differential signal transmission cable according to claim 4, wherein the $a_1$, the $b_1$ and the $b_2$ are a common value.

6. The differential signal transmission cable according to claim 1, further comprising:

a covering member for covering the shield conductor, wherein the shield conductor comprises an insulating member and a conductive film on a surface of the insulating member opposite the covering member.

7. The differential signal transmission cable according to claim 1, wherein the shield conductor comprises a joint or an overlapped region along a longitudinal direction of the insulation, and wherein the covering member comprises a spiral joint or overlapped region on the shield conductor.

8. The differential signal transmission cable according to claim 1, wherein the shield conductor comprises a spiral joint or overlapped region on the insulation, and wherein the covering member comprises a braid.

9. The differential signal transmission cable according to claim 1, wherein the insulation comprises a foamed material.

10. The differential signal transmission cable according to claim 9, wherein the insulation comprises an outer layer having a degree of foaming lower than that of an internal portion.

11. The differential signal transmission cable according to claim 1, wherein the oval shape has a width in the first direction larger than a width in the second direction.

12. The differential signal transmission cable according to claim 1, wherein the first curved portion comprises an arc of a perfect circle.

* * * * *